US011146872B2

(12) United States Patent
Matsuba

(10) Patent No.: US 11,146,872 B2
(45) Date of Patent: Oct. 12, 2021

(54) ELECTRONIC KEYBOARD INSTRUMENT AND SOUND RELEASING METHOD THEREOF

(71) Applicant: Roland Corporation, Shizuoka (JP)

(72) Inventor: Masaaki Matsuba, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 16/842,722

(22) Filed: Apr. 7, 2020

(65) Prior Publication Data

US 2020/0322705 A1 Oct. 8, 2020

(30) Foreign Application Priority Data

Apr. 8, 2019 (JP) ..... JP2019-073690

(51) Int. Cl.
*H04R 1/02* (2006.01)
*G10H 1/32* (2006.01)
*H04R 9/04* (2006.01)

(52) U.S. Cl.
CPC ..... *H04R 1/025* (2013.01); *G10H 1/32* (2013.01); *H04R 9/045* (2013.01); *G10H 2220/461* (2013.01); *H04R 2201/02* (2013.01); *H04R 2201/40* (2013.01)

(58) Field of Classification Search
CPC .... H04R 1/025; H04R 9/045; H04R 2201/40; H04R 2201/02; H04R 9/06; H04R 7/04; G10H 1/32; G10H 2220/461; G10H 2210/295
See application file for complete search history.

(56) References Cited

U.S. PATENT DOCUMENTS 4,322,583 A * 3/1982 Maeda ..... H04R 7/04 381/412
4,653,103 A * 3/1987 Mori ..... H04R 9/047 381/117
5,283,836 A * 2/1994 Trufitt ..... H04R 1/26 381/398
6,008,714 A 12/1999 Okuda et al.
6,188,775 B1 * 2/2001 Azima ..... B42D 15/022 381/190
6,399,870 B1 * 6/2002 Azima ..... B42D 15/022 181/148
6,437,230 B2 * 8/2002 Torii ..... G10H 1/0091 381/103

(Continued)

FOREIGN PATENT DOCUMENTS

JP 2012037840 2/2012
JP 2012039553 2/2012
JP 2012039554 2/2012

*Primary Examiner* — Jeffrey Donels
(74) *Attorney, Agent, or Firm* — JCIPRNET

(57) ABSTRACT

Provided is an electronic keyboard instrument and sound releasing method thereof. The electronic keyboard instrument includes: a plurality of keys, a housing that supports the plurality of keys, and one or more speakers arranged in the housing. At least one of the speakers is configured as a flat-plate speaker that includes a vibrating membrane on which a pattern of a conducting wire is formed and a pair of magnet plates disposed facing both surfaces of the vibrating membrane, and the flat-plate speaker vibrates the vibrating membrane with an electromagnetic force accompanying energization of the conducting wire.

19 Claims, 6 Drawing Sheets

(56) References Cited

U.S. PATENT DOCUMENTS

| | | | | |
|---|---|---|---|---|
| 7,002,070 | B2 * | 2/2006 | Katz | G10H 1/32 84/600 |
| 7,078,611 | B2 * | 7/2006 | Izumi | G10H 1/32 84/177 |
| 7,149,321 | B2 * | 12/2006 | Hutt | B60R 11/0223 381/389 |
| 7,236,608 | B2 * | 6/2007 | Garner | B60R 11/0223 381/399 |
| 10,674,271 | B2 * | 6/2020 | Ikeuchi | H04R 7/26 |
| 2012/0006185 | A1 * | 1/2012 | Mishima | H04R 1/028 84/744 |
| 2013/0061733 | A1 * | 3/2013 | Ohnishi | G10C 9/00 84/174 |
| 2013/0180387 | A1 * | 7/2013 | Takahashi | G10H 1/32 84/644 |
| 2015/0194138 | A1 * | 7/2015 | Suenaga | G10C 3/12 84/744 |

* cited by examiner (a)

(b)

ELECTRONIC KEYBOARD INSTRUMENT AND SOUND RELEASING METHOD THEREOF

CROSS-REFERENCE TO RELATED APPLICATION

This application claims the priority of Japan patent application serial no. 2019-073690, filed on Apr. 8, 2019. The entirety of the above-mentioned patent application is hereby incorporated by reference herein and made a part of this specification.

BACKGROUND OF THE DISCLOSURE

Technical Field

The disclosure relates to an electronic keyboard instrument, particularly to an electronic keyboard instrument including a flat-plate-shaped speaker, and a sound releasing method thereof.

Related Art

The electronic keyboard instrument including a flat-plate-shaped speaker has been known. For example, in patent literature 1, a technology in which an electrostatic surface speaker is used in the electronic keyboard instrument is described. As in this technology, by using a surface speaker thinner than a cone type speaker, the space in the thickness direction of the surface speaker (the output direction of musical sounds) can be effectively utilized. In other words, the freedom degree of attachment of the speaker can be improved in a limited space in a housing of the electronic keyboard instrument.

LITERATURE OF RELATED ART

Patent Literature

[Patent literature 1] Japanese Patent Laid-Open No. 2012-037840 (for example, Paragraphs 0019, 0079 and 0080, FIGS. 2, 5 and 8)

However, in the above conventional technology, because the surface speaker is configured as an electrostatic speaker, when a vibrating electrode sheet is vibrated, it is necessary to apply a bias voltage of hundreds of volts between a first fixed electrode sheet or a second fixed electrode sheet and the vibrating electrode sheet. Thus, a power supply system dedicated to the surface speaker is required, and thus the product cost of the electronic keyboard instrument increases as compared with the case of using the cone type speaker. That is, when the electrostatic surface speaker is used, although the freedom degree of attachment of the speaker can be improved, the product cost of the electronic keyboard instrument increases.

SUMMARY

The electronic keyboard instrument of the disclosure includes a plurality of keys, a housing that supports the plurality of keys, and one or more speakers arranged in the housing; at least one of the speakers is configured as a flat-plate speaker that includes a vibrating membrane on which a pattern of a conducting wire is formed and a pair of magnet plates disposed facing both surfaces of the vibrating membrane, and the flat-plate speaker vibrates the vibrating membrane with an electromagnetic force accompanying energization of the conducting wire.

Figure 3:
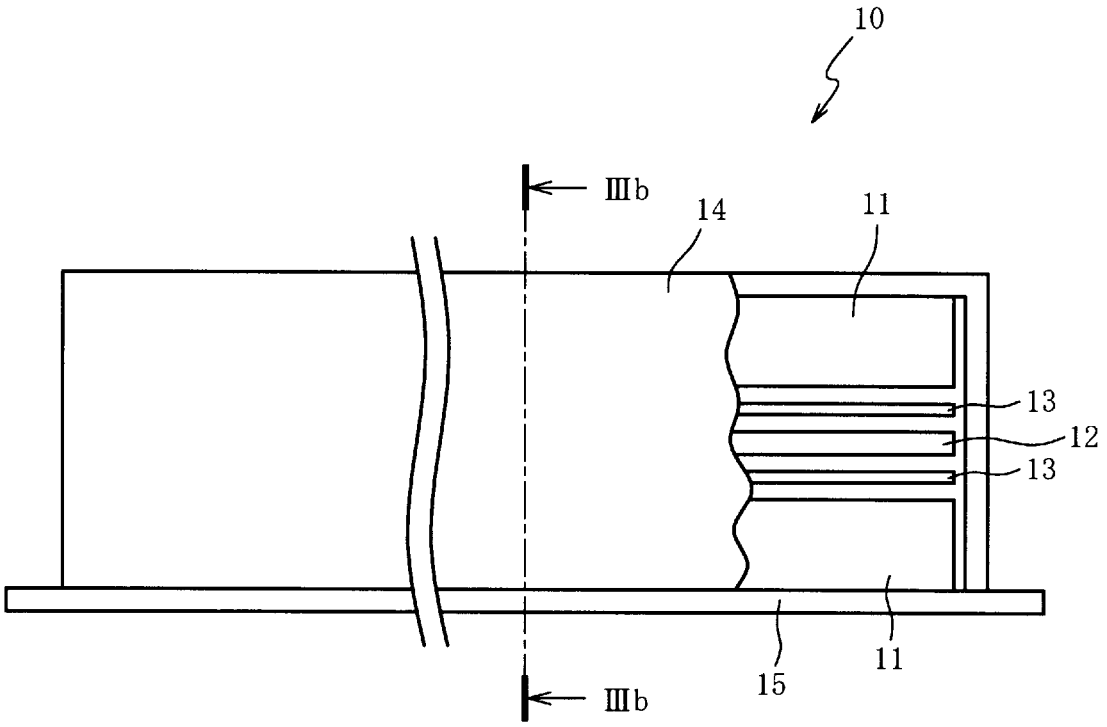
Figure 3:
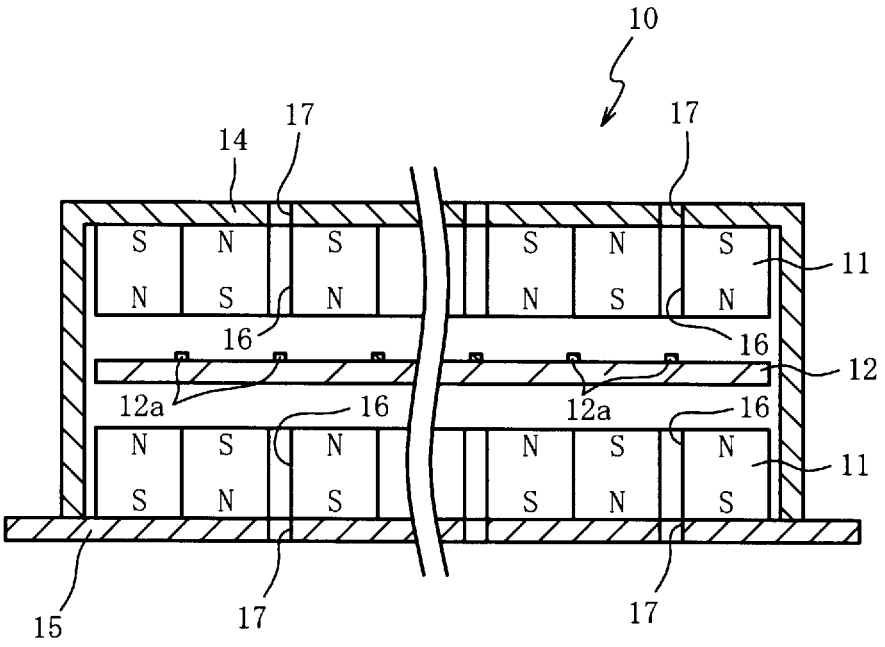

(a) of FIG. 3 is a side view of a flat-plate speaker, and (b) of FIG. 3 is a cross-sectional view of the flat-plate speaker along line IIIb-IIIb in (a) of FIG. 3.

Figure 4:
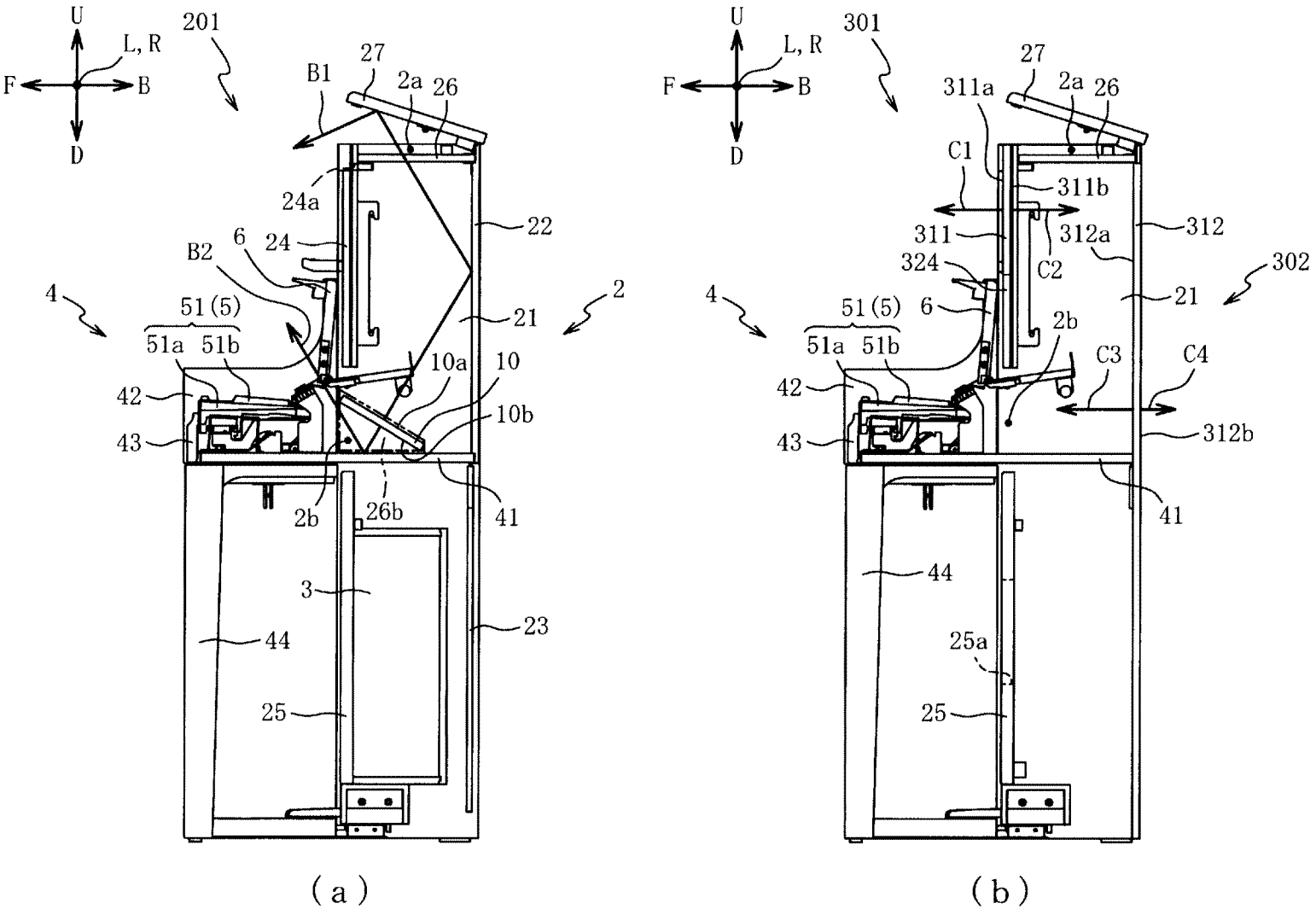

(a) of FIG. 4 is a side view of an electronic keyboard instrument in a second embodiment, and (b) of FIG. 4 is a side view of an electronic keyboard instrument in a third embodiment.

Figure 5:
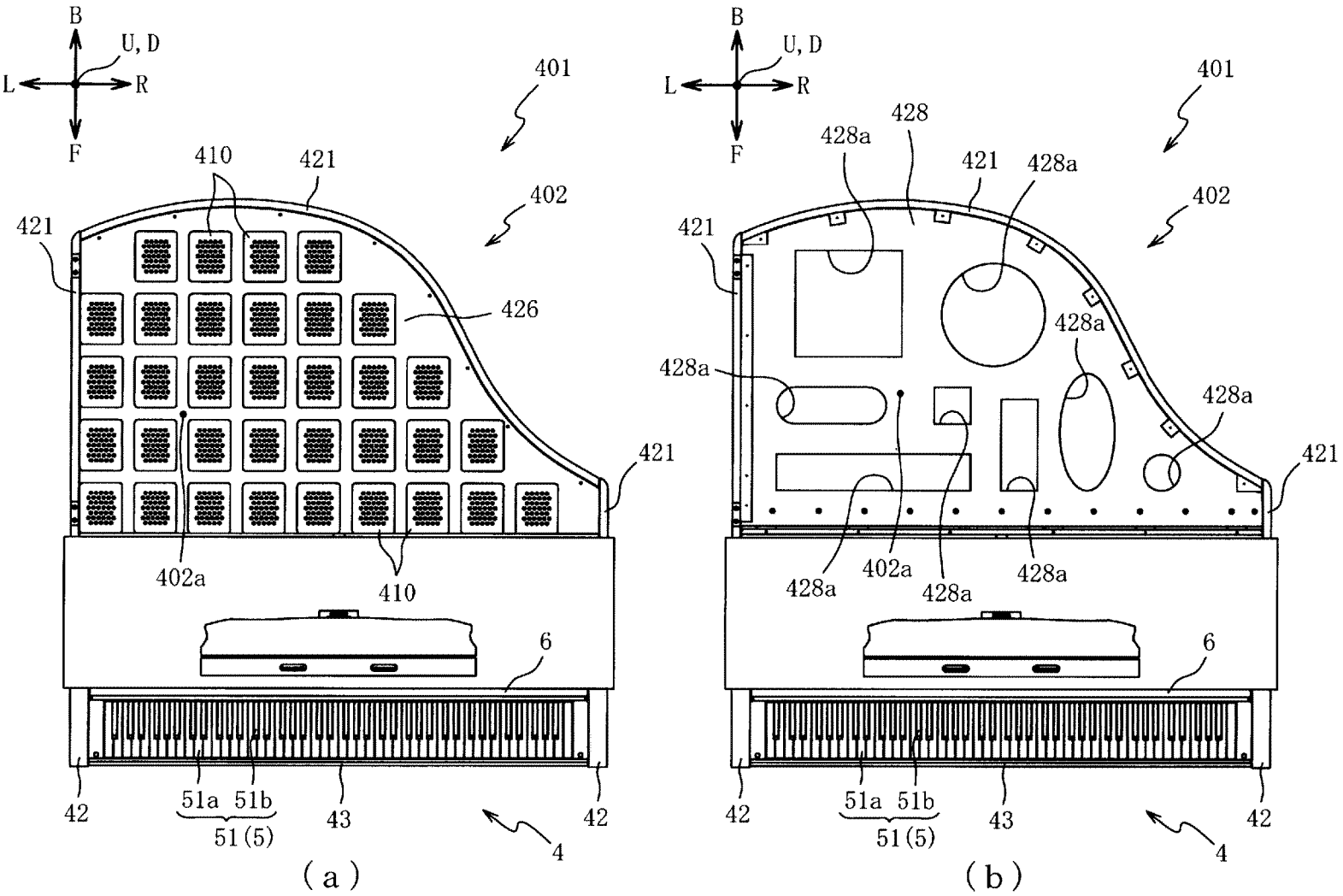

(a) and (b) of FIG. 5 are top views of an electronic keyboard instrument in a fourth embodiment.

Figure 6:
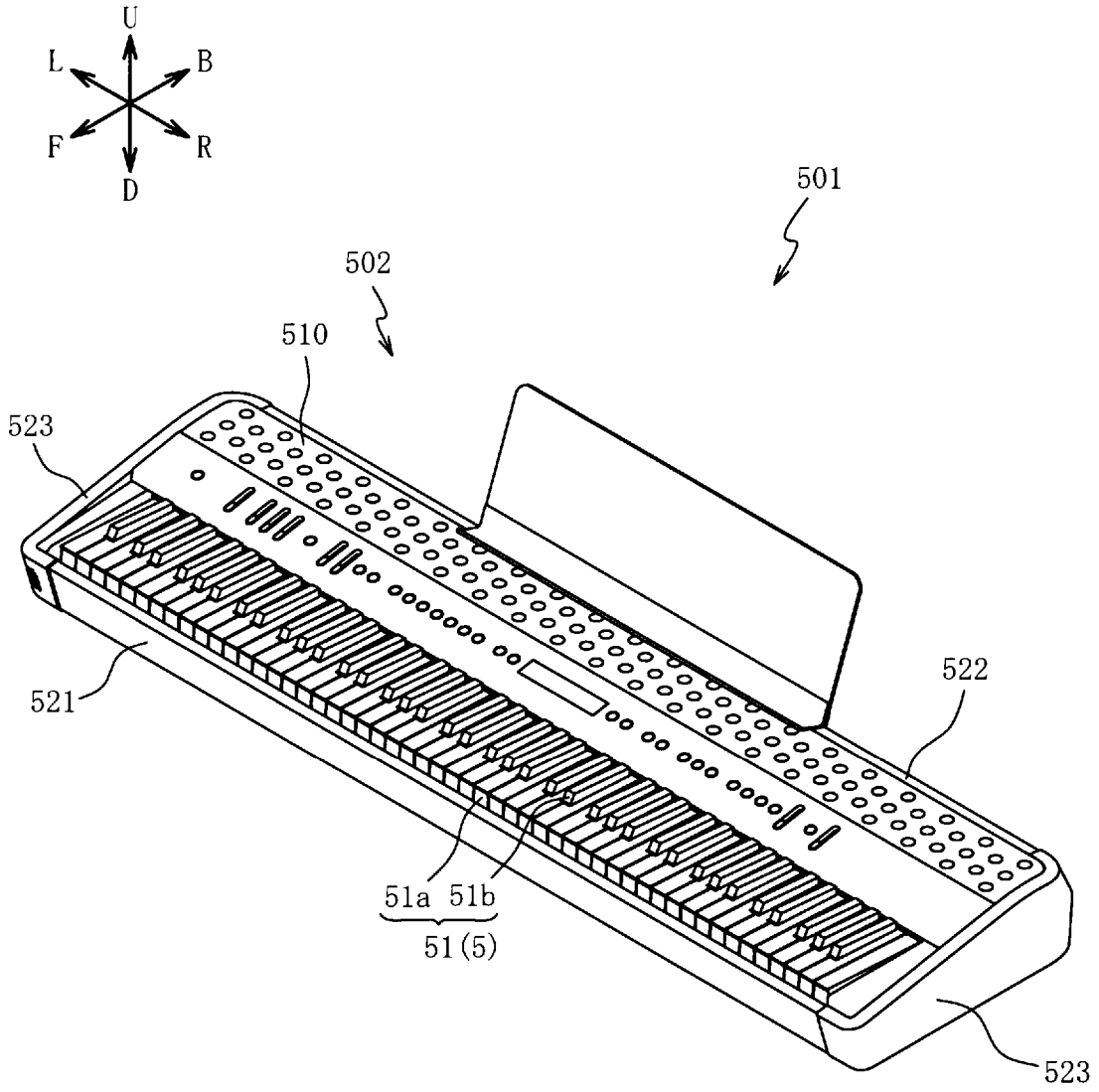

FIG. 6 is a front perspective view of an electronic keyboard instrument in a fifth embodiment.

DESCRIPTION OF THE EMBODIMENTS

The disclosure has been made to solve the above problem and provides an electronic keyboard instrument capable of improving the freedom degree of attachment of the speaker and suppressing the increase in product cost.

Hereinafter, preferable embodiments are described with reference to the accompany drawings. First, the configuration of an electronic keyboard instrument 1 in a first embodiment is described with reference to FIGS. 1 and 2.

Figure 1:
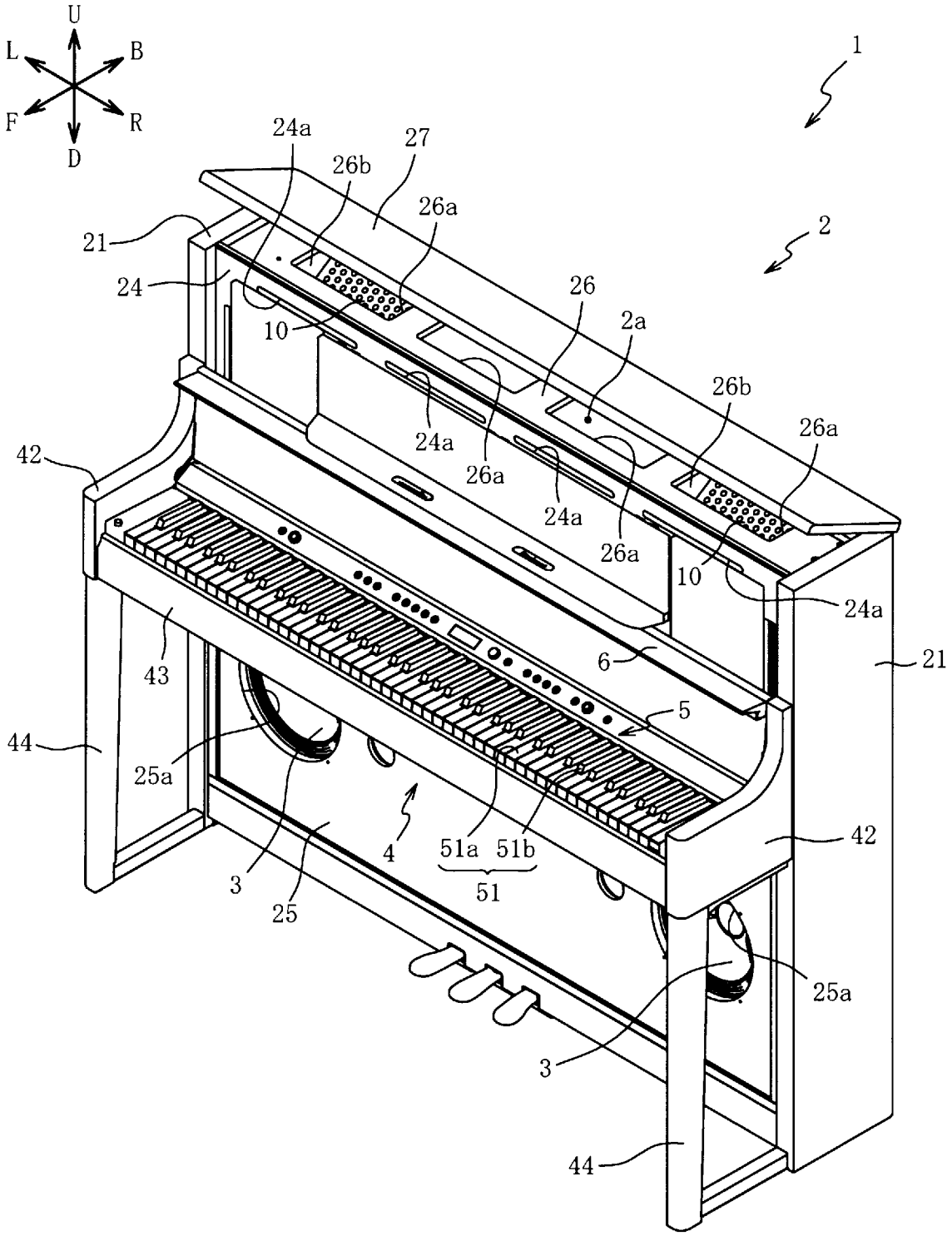
FIG. 1 is a front perspective view of an electronic keyboard instrument in a first embodiment.
Figure 2:
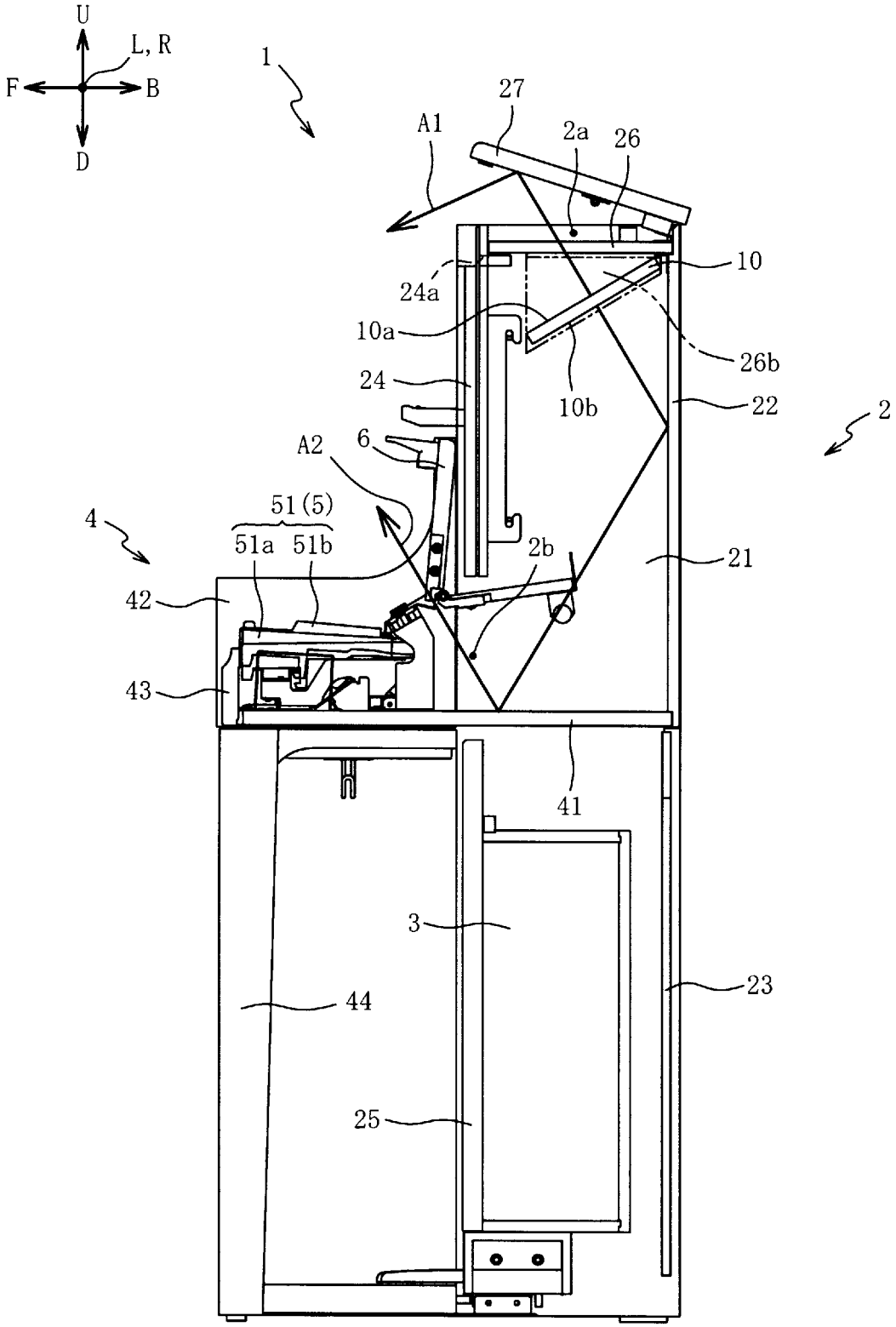
FIG. 2 is a side view of the electronic keyboard instrument.

FIG. 1 is a front perspective view of the electronic keyboard instrument 1 in the first embodiment. FIG. 2 is a side view of the electronic keyboard instrument 1 and shows a state in which a side plate 21 and a side surface plate 42 on the near side in a direction perpendicular to the paper plan are detached. Besides, an arrow F-B, an arrow U-D, and an arrow L-R in FIG. 1 respectively represent a front-back direction, an up-down direction, and a left-right direction of the electronic keyboard instrument 1, and the same applies to FIG. 2 and subsequent drawings. In addition, in FIG. 1, in order to facilitate understanding, a top plate 27 is disposed in a state of opening greater than actual with respect to a speaker supporting member 26, and in FIG. 2, a bracket 26*b* is shown by a dashed-two dotted line.

As shown in FIGS. 1 and 2, the electronic keyboard instrument 1 is configured as an upright electronic keyboard instrument (electronic piano) including: a main body portion 2, a pair of cone type speakers 3 disposed on the front surface of the main body portion 2 (the surface on the arrow F side), a key supporting portion 4 disposed upward (on the arrow U side) of the cone type speakers 3 and protruding from the front surface of the main body portion 2, a keyboard unit 5 supported by the key supporting portion 4, a keyboard cover 6 for openably covering the keyboard unit 5, and a pair of flat-plate speakers 10 disposed on the upper surface side of the main body portion 2.

The main body portion 2 is a housing formed using plate-shaped bodies made of resin, metal or wood and is formed into a substantially rectangular parallelepiped shape elongated in the up-down direction. The main body portion 2 includes: a pair of side plates 21 disposed at a predetermined interval in the left-right direction (the arrow L-R direction), an upper side back plate 22 and a lower side back plate 23 (see FIG. 2) that connect the back ends of the pair of side plates 21 (the ends on the arrow B side) in the left-right direction, an upper side front plate 24 and a lower side front plate 25 that connect the front ends of the pair of side plates 21 in the left-right direction on the frontward side of the upper side back plate 22 and the lower side back plate 23, the speaker supporting member 26 fixed to the upper end side of the upper side back plate 22 and the upper side front plate 24, and the top plate 27 rotatably supported by the speaker supporting member 26 via a hinge.

An opening portion 2*a* is formed on the upper surface of the main body portion 2, and an opening surface of the opening portion 2*a* is opened and closed by the top plate 27. Besides, the "opening surface" of the opening portion 2*a* refers to a surface along the upper ends of the pair of side plates 21, the upper side back plate 22, and the upper side front plate 24, and is configured so that the top plate 27 can rotate around the axis extending along the edge of the opening surface on the backward side.

The upper side back plate 22 (see FIG. 2) constitutes a back surface of the main body portion 2 on the upper part side, and the lower side back plate 23 constitutes a back surface of the main body portion 2 on the side lower than the upper side back plate 22 (the arrow D side). In addition, the upper side front plate 24 constitutes a front surface of the main body portion 2 on the upper part side, and the lower side front plate 25 constitutes a front surface of the main body portion 2 on the side lower than the upper side front plate 24.

The upper side front plate 24 and the lower side front plate 25 are disposed at a predetermined interval in the up-down direction, and thereby an opening portion 2*b* (see FIG. 2) is formed between the upper side front plate 24 and the lower side front plate 25 (on the front surface of the main body portion 2), and the key supporting portion 4 is arranged on the frontward side of the opening portion 2*b*.

The key supporting portion 4 includes: a chassis 41 (see FIG. 2) that supports the keyboard unit 5, a pair of side surface plates 42 disposed on the left and right end sides of the chassis 41, a front surface plate 43 that connects the front ends of the pair of side surface plates 42 (the ends on the arrow F side) in the left-right direction, and a pair of leg portions 44 that protrudes downward (toward the arrow D side) from the lower surface of the chassis 41.

The chassis 41 is a plate-shaped body made of resin, metal, or wood. The chassis 41 is disposed in a state of stretching to the inside and the outside of the main body portion 2 with the opening portion 2*b* (see FIG. 2) sandwiched therebetween, and the back end of the chassis 41 is fixed to the upper side back plate 22 while being in contact with the lower end part of the upper side back plate 22. In addition, the dimension of the chassis 41 in the left-right direction (the arrow L-R direction) is formed equal to or slightly smaller than the distance at which the pair of side plates 21 faces each other.

Thereby, the inside of the main body portion 2 is divided, by the chassis 41, into an upper space surrounded by the pair of side plates 21, the upper side back plate 22 and the upper side front plate 24, and a lower space surrounded by the pair of side plates 21, the lower side back plate 23 and the lower side front plate 25. Besides, the chassis 41 is disposed on the lower end side of the opening portion 2*b* (at a position near the upper end of the lower side front plate 25).

The part of the chassis 41 on the front end side (closer to the frontward side than the opening portion 2*b*) is supported by the pair of leg portions 44, and the keyboard unit 5 is supported by the part of the chassis 41 on the front end side.

The keyboard unit 5 includes a plurality (88 in the embodiment) of keys 51 disposed on the frontward side of the opening portion 2*b*. The keys 51 are configured by a plurality (52 in the embodiment) of white keys 51*a* for playing dry sounds and a plurality (36 in the embodiment) of black keys 51*b* for playing derived sounds, and the plurality of white keys 51*a* and black keys 51*b* is arranged to line up in the left-right direction. The keyboard cover 6 is configured to protect the keys 51. The keyboard cover 6 rotates upward with respect to the keys 51, and thereby the keys 51 are exposed.

The electronic keyboard instrument 1 includes a switch (not shown) that is turned on/off by the oscillation of the keys 51 determined by the operations of a player (key pressing or key releasing), and this switch is turned on/off when the keys 51 are pressed or released by the player. Key pressing information (note information) of the keys 51 is detected according to the on/off operation of the switch, and a musical sound signal based on this detection result is output to the cone type speaker 3 and the flat-plate speaker 10. Thereby, the musical sound based on the key pressing information is output from the cone type speaker 3 and the flat-plate speaker 10.

The cone type speaker 3 is a dynamic speaker (a so-called cone type speaker) in which a vibrating plate is formed into a cone shape. In the embodiment, the cone type speaker 3 mainly outputs low-pitched musical sounds. A pair of sound releasing holes 25*a* (see FIG. 1) with a predetermined interval in the left-right direction is formed on the lower side front plate 25 of the main body portion 2, and the cone type speaker 3 is fitted into each of the pair of sound releasing holes 25*a*.

The flat-plate speakers 10 are supported by the speaker supporting member 26 near the opening portion 2*a* (at a position where an up-down interval between the opening surface of the opening portion 2*a* and the back end of the flat-plate speakers 10 is within 20 cm). The speaker supporting member 26 is a plate-shaped body arranged substantially parallel to the opening surface of the opening portion 2*a*, and the speaker supporting member 26 is fixed to the upper end side of the upper side back plate 22 and the upper side front plate 24.

In the speaker supporting member 26, a plurality (four in the embodiment) of through holes 26*a* (see FIG. 1) disposed to line up in the left-right direction (the arrow L-R direction) is formed. The through holes 26*a* are holes for passing the musical sounds output from the flat-plate speaker 10.

The speaker supporting member 26 includes the bracket 26*b* protruding downward from the speaker supporting member 26. The flat-plate speakers 10 are fixed to the bracket 26*b*, and thereby the flat-plate speakers 10 are disposed facing the through holes 26*a* of the speaker supporting member 26 in the up-down direction. In addition, the flat-plate speakers 10 are supported by the speaker supporting member 26 in a state of being lowered and inclined toward the frontward side with respect to the speaker supporting member 26 (the opening portion 2*a*).

The flat-plate speaker 10 is formed into a flat-plate shape elongated in the left-right direction (the arrow L-R direction), and the outer shape of the flat-plate speaker 10 is formed slightly smaller than the inner shape of the through holes 26*a* (see FIG. 1) of the speaker supporting member 26. Among the plurality of though holes 26*a*, the flat-plate speaker 10 is disposed facing each of a pair of through holes 26*a* located at the left and right ends.

On the upper end side of the upper side front plate 24, a plurality (four in the embodiment) of sound releasing holes 24*a* is formed at positions facing the flat-plate speakers 10 in the front-back direction. The sound releasing holes 24*a* are through holes for releasing the musical sounds output from the flat-plate speakers 10 toward the frontward side and are formed into a slit shape elongated in the left-right direction.

Here, the configuration of the flat-plate speaker 10 is described with reference to FIG. 3. (a) of FIG. 3 is a side view of the flat-plate speaker 10, and (b) of FIG. 3 is a cross-sectional view of the flat-plate speaker 10 along line IIIb-IIIb in (a) of FIG. 3. Besides, in (a) of FIG. 3, a state in which a part of a case member 14 is broken is shown. In addition, in (b) of FIG. 3, illustration of buffer members 13 shown in (a) of FIG. 3 is omitted, and hatching of magnet plates 11 is omitted.

As shown in (a) of FIG. 3, the flat-plate speaker 10 includes: a pair of magnet plates 11 disposed facing each other in the up-down direction, a vibrating membrane 12 disposed between the pair of magnet plates 11, buffer members 13 respectively disposed between the pair of magnet plates 11 and the vibrating membrane 12 and formed using non-woven fabrics having air permeability, a case member 14 being box-like which accommodates the pair of magnet plates 11, the vibrating membrane 12, and the plurality of buffer members 13 and of which the lower surface is opened, and a cover member 15 which blocks the case member 14.

Besides, in order to facilitate understanding, (a) and (b) of FIG. 3 show a state in which the thickness dimensions of the vibrating membrane 12, the buffer members 13, the case member 14, and the cover member 15 are greater than actual dimensions, and a state in which the distances at which the magnet plates 11, the vibrating membrane 12, and the buffer member 13 face each other are larger than actual distances.

As shown in (b) of FIG. 3, on the upper and lower surfaces of the magnet plates 11, N-poles and S-poles are alternately lined up and magnetized in one direction (the left-right direction in (b) of FIG. 3), and the N-poles and the S-poles are formed to extend in a direction orthogonal to the arrangement direction of the magnetic poles (the direction perpendicular to the paper plane in (b) of FIG. 3). The vibrating membrane 12 is formed using a resin film having flexibility, and a pattern of the conducting wire 12*a* meandering in the arrangement direction of the magnetic poles of the magnet plates 11 (the left-right direction in (b) of FIG. 3) is formed on the upper surface of the vibrating membrane 12.

At a position serving as the boundary of the N-poles and the S-poles in the arrangement direction of the magnetic poles (the left-right direction in (b) of FIG. 3), the vibrating membrane 12 is disposed along the longitudinal direction of the conducting wire 12*a*. Thus, an electromagnetic force acts on the vibrating membrane 12 due to energization of the conducting wire 12*a* based on the musical sound signal input to the flat-plate speaker 10, and the vibrating membrane 12 vibrates (shifts) in the thickness direction due to the electromagnetic force. Musical sounds generated by the vibration of the vibrating membrane 12 are released outside via sound releasing holes 16 formed on the magnet plates 11 or sound releasing holes 17 formed on the case member 14 and the cover member 15.

Thereby, the musical sounds based on the musical sound signal during key pressing are output from the flat-plate speaker 10. The musical sounds output from the flat-plate speaker 10 are plane waves obtained by the vibration in the thickness direction of the vibrating membrane 12, and thus musical sounds having high directionality are output from both surfaces of the flat-plate speaker 10. Besides, a detailed configuration of the flat-plate speaker 10 or the generation method of the musical sounds is the same as the known technology (for example, Japanese Patent Laid-Open No. 9-331596, and the like), and thus detailed description is omitted.

As described above, in the embodiment, the musical sounds are output by a fully-driven flat-plate speaker 10 that has the vibrating membrane 12 on which the conducting wire 12*a* is formed and the magnet plates 11 disposed facing the vibrating membrane 12, and that vibrates the vibrating membrane 12 with an electromagnetic force accompanying the energization to the conducting wire 12*a*. Thus, when the flat-plate speaker 10 is driven (the vibrating membrane 12 is vibrated), it is not necessary to apply a bias voltage as in a case of using an electrostatic speaker. Thus, power supply for applying the voltage is not required. That is, by using a thin flat-plate speaker 10, it is possible to improve the freedom degree of speaker attachment in a limited space inside the main body portion 2 and to suppress the increase in product cost of the electronic keyboard instrument 1.

Returning to FIG. 2, the releasing of the musical sounds from the flat-plate speaker 10 is described. Arrows A1 and A2 in FIG. 2 respectively show sound releasing paths of the musical sounds output from a front surface 10*a* and a back surface 10*b* of the flat-plate speaker 10. Besides, the surface on the top plate 27 side (the arrow U side) of the flat-plate speaker 10 is the front surface 10*a*, and the surface on the upper side back plate 22 side (the arrow D side) is the back surface 10*b*.

The flat-plate speaker 10 is disposed in a posture with the front surface 10*a* thereof facing the opening portion 2*a* (the top plate 27) of the main body portion 2, and thus the musical sounds output from the front surface 10*a* of the flat-plate speaker 10 are directly transmitted toward the top plate 27 through the opening portion 2*a*. Because the top plate 27 in an open state is disposed to be raised and inclined (in the embodiment, inclined by 20°) to the frontward side with respect to the opening surface of the opening portion 2*a*, the musical sounds output from the front surface 10*a* of the flat-plate speaker 10 are reflected by the top plate 27 and released toward the frontward side of the electronic keyboard instrument 1 (see the arrow A1).

In this manner, the musical sounds output from the front surface 10*a* of the flat-plate speaker 10 are reflected by the top plate 27 and released to the outside of the main body portion 2, and thereby musical sounds simulating an acoustic piano can be easily released. Furthermore, the musical sounds output from the front surface 10*a* of the flat-plate speaker 10 are released toward the frontward side of the electronic keyboard instrument 1, and thus can be easily released to the player.

Here, in order to release the musical sounds reflected to the frontward side of the electronic keyboard instrument 1 by the top plate 27 toward the side lower than the opening portion 2*a* (toward the obliquely lower side of the front), it is necessary to set the angle of the top plate 27 to 45° or less with respect to the opening surface of the opening portion 2*a*. In this case, for example, when the flat-plate speaker 10 is configured to be supported parallel to the opening surface of the opening portion 2*a*, the musical sounds output from the front surface 10*a* of the flat-plate speaker 10 are reflected by the top plate 27 and easily transmitted toward the inside of the main body portion 2. Thus, the musical sounds output from the front surface 10*a* of the flat-plate speaker 10 cannot be effectively released to the outside of the electronic keyboard instrument 1.

On the contrary, in the embodiment, the front ends of the pair of flat-plate speakers 10 are disposed closer to the inner side (downward) of the main body portion 2 than the back ends, and are supported by the speaker supporting member 26 in a state of being lowered and inclined to the frontward side (in the embodiment, a state of being inclined by 28° with respect to the opening surface of the opening portion 2*a*).

Thereby, even when the angle of the top plate 27 is set to 45° or less with respect to the opening surface of the opening portion 2*a*, the musical sounds reflected by the top plate 27 can be prevented from being transmitted to the inside of the main body portion 2. That is, compared with the case in which the flat-plate speakers 10 are parallel to the opening surface of the opening portion 2*a*, components of the musical sounds returning to the inside of the main body portion 2 can be reduced. Thus, it is possible to release the musical sounds reflected to the frontward side of the electronic keyboard instrument 1 by the top plate 27 toward the side lower than the opening portion 2*a* (toward the obliquely lower side of the front), and to effectively release the musical sounds output from the front surface 10*a* of the flat-plate speaker 10 to the outside of the electronic keyboard instrument 1.

In addition, the back end of the flat-plate speaker 10 is disposed lower than the opening portion 2*a* (on the inner side of the main body portion 2), and thus the musical sounds output from the front surface 10*a* on the back end side of the flat-plate speaker 10 can be easily transmitted to the front end side of the top plate 27. Thereby, because the musical sounds reflected by the top plate 27 are easily released to the outside of the main body portion 2 (not prone to be transmitted to the inside of the main body portion 2), the musical sounds output from the front surface 10*a* of the flat-plate speaker 10 can be effectively released toward the frontward side of the electronic keyboard instrument 1.

In this manner, the flat-plate speaker 10 is disposed to be lowered and inclined toward the frontward side with respect to the opening surface of the opening portion 2*a*, and the back end of the flat-plate speaker 10 is disposed lower than the opening portion 2*a*, and thereby the musical sounds can be effectively released toward the frontward side of the electronic keyboard instrument 1 even when the musical sounds output from the flat-plate speaker 10 have high directionality.

In addition, because the sound releasing holes 24*a* are formed on the upper side front plate 24 on the frontward side of the flat-plate speaker 10, even if the musical sounds reflected by the top plate 27 return to the inside of the main body portion 2, the musical sounds can also be easily released to the outside of the main body portion 2 through the sound releasing holes 24*a*. Furthermore, even in a state that the top plate 27 blocks the opening portion 2*a*, the musical sounds output from the front surface 10*a* of the flat-plate speaker 10 (the musical sounds reflected by the top plate 27) can be released toward the frontward side of the electronic keyboard instrument 1 through the sound releasing holes 24*a*.

On the other hand, the musical sounds output from the back surface 10*b* of the flat-plate speaker 10 are transmitted toward the inside of the main body portion 2. Because the flat-plate speaker 10 is disposed to be lowered and inclined toward the frontward side, the musical sounds output from the back surface 10*b* of the flat-plate speaker 10 are transmitted toward the upper side back plate 22 of the main body portion 2. Thereby, the musical sounds can be reflected by the upper side back plate 22 and easily released toward the frontward side of the electronic keyboard instrument 1.

On the lower side of the flat-plate speaker 10, the chassis 41 is disposed so as to divide the upper and lower spaces of the main body portion 2, and thus the musical sounds reflected by the upper side back plate 22 are transmitted toward the chassis 41. Thus, the musical sounds reflected by the upper side back plate 22 can be prevented from being released to the space on the side lower than the chassis 41.

Because the chassis 41 is disposed to extend from the upper side back plate 22 toward the lower end side of the opening portion 2*b* of the main body portion 2 (the gap between the upper side front plate 24 and the lower side front plate 25), the musical sounds reflected by the chassis 41 are transmitted toward the keyboard unit 5 side through the opening portion 2*b* (see the arrow A2). The musical sounds transmitted toward the keyboard unit 5 side are released to the frontward side (the arrow F side) of the electronic keyboard instrument 1 through gaps between the keys 51.

In this manner, the musical sounds output from the back surface 10*b* of the flat-plate speaker 10 are reflected toward the opening portion 2*b* by the upper side back plate 22 or the chassis 41, and thereby the musical sounds can be easily released toward the frontward side (the player) of the electronic keyboard instrument 1.

In addition, in order to reflect the musical sounds output from the back surface 10*b* of the flat-plate speaker 10, it is also possible to separately arrange a reflection board different from the chassis 41, but in the embodiment, the chassis 41 can be made to both function as the reflection board and function to support the keyboard unit 5. Thereby, the number of parts can be reduced, and thus the product cost of the electronic keyboard instrument 1 can be reduced.

Besides, when the space formed inside the main body portion 2 is divided by the chassis 41, the chassis 41 may not be completely in close contact with the side plate 21 and the upper side back plate 22. That is, as long as the musical sounds output from the back surface 10*b* of the flat-plate speaker 10 can be reflected toward the opening portion 2*b*, a small gap may be formed between the chassis 41 and the side plate 21 or the upper side back plate 22.

In addition, the pair of flat-plate speakers 10 may output the musical sounds having the same tone or the musical sounds having different tones. The tone refers to, for example, resonance of strings, echo of a table, echo of the housing, a sound obtained by a hammer dubbing a string, and the like among the musical sounds output from the acoustic piano. By respectively outputting the musical sounds having different tones from the pair of flat-plate speakers 10, the musical sounds simulating the acoustic piano can be easily released.

As described above, according to the electronic keyboard instrument 1 of the embodiment, the musical sounds output from the flat-plate speaker 10 are released toward the player side from the opening portion 2*a* on the upper surface side or the opening portion 2*b* on the front surface side (the gaps between the keys 51) of the main body portion 2, and thus a steric sound-field space simulating the acoustic piano can be formed. Furthermore, because the musical sounds output from the flat-plate speaker 10 have high directionality, the musical sounds can be released toward the outside of the electronic keyboard instrument 1 through small gaps and can be delivered to the audience at positions separated from the electronic keyboard instrument 1 in addition to the player.

Next, the configuration of an electronic keyboard instrument 201 in a second embodiment is described with reference to (a) of FIG. 4. Besides, the same parts as in the above first embodiment are denoted by the same reference signs, and description thereof is omitted.

(a) of FIG. 4 is a side view of the electronic keyboard instrument 201 in the second embodiment, and shows a state in which the side plate 21 and the side surface plate 42 on the near side in the direction perpendicular to the paper plane are detached. Besides, arrows B1 and B2 in (a) of FIG. 4 respectively represent sound releasing paths of the musical sounds output from the front surface 10*a* and the back surface 10*b* of the flat-plate speaker 10. In addition, in (a) of FIG. 4, the bracket 26*b* is shown by a dashed-two dotted line.

As shown in (a) of FIG. 4, regarding the electronic keyboard instrument 201 in the second embodiment, a pair of flat-plate speakers 10 is supported near the chassis 41 (at a position where the up-down interval between the upper surface of the chassis 41 and the back end of the flat-plate speaker 10 is within 20 cm). Although not shown, the pair of flat-plate speakers 10 is arranged in the left-right direction (the arrow L-R direction), and the arrangement positions of the pair of flat-plate speakers 10 in the left-right direction are the same as the positions of the pair of flat-plate speakers in the first embodiment.

The flat-plate speakers 10 are supported by the chassis 41 via the bracket 26*b* in a state of being raised and inclined toward the frontward side. In the embodiment, the surface on the upper side back plate 22 side (the arrow U side) is the front surface 10*a* of the flat-plate speaker 10, and the surface on the chassis 41 side (the arrow D side) is the back surface 10*b*.

Because the flat-plate speaker 10 is supported by the chassis 41 in the state of being raised and inclined toward the frontward side, the musical sounds output from the front surface 10*a* of the flat-plate speaker 10 are reflected by the upper side back plate 22 and transmitted toward the top plate 27 (the opening portion 2*a*). Because the top plate 27 is disposed to be raised and inclined toward the frontward side with respect to the opening portion 2*a*, the musical sounds transmitted toward the top plate 27 are reflected by the top plate 27 and released to the frontward side of the electronic keyboard instrument 201 (see the arrow B1).

On the other hand, the musical sounds output from the back surface 10*b* of the flat-plate speaker 10 are reflected by the chassis 41 to thereby be transmitted toward the keyboard unit 5 side through the opening portion 2*b*. The musical sounds transmitted to the keyboard unit 5 side are released to the frontward side of the electronic keyboard instrument 201 through the gaps between the keys 51 (see the arrow B2).

In this manner, the musical sounds output from the front surface 10*a* or the back surface 10*b* of the flat-plate speaker 10 are reflected by the top plate 27, the upper side back plate 22, and the chassis 41, and thereby the musical sounds can be easily released toward the frontward side of the electronic keyboard instrument 201. Furthermore, the musical sounds output from the flat-plate speaker 10 are released toward the player side from the opening portions 2*a* and 2*b* on the upper surface and the front surface of the main body portion 2, and thereby the steric sound-field space simulating the acoustic piano can be formed.

Next, the configuration of an electronic keyboard instrument 301 in a third embodiment is described with reference to (b) of FIG. 4. Besides, the same parts as in the above embodiments are denoted by the same reference signs, and description thereof is omitted. (b) of FIG. 4 is a side view of the electronic keyboard instrument 301 in the third embodiment and shows a state in which the side plate 21 and the side surface plate 42 on the near side in the direction perpendicular to the paper plane are detached. Besides, arrows C1, C2, C3, and C4 in (b) of FIG. 4 respectively represent sound releasing paths of musical sounds output from flat-plate speakers 311 and 312.

As shown in (b) of FIG. 4, regarding the electronic keyboard instrument 301 in the third embodiment, an upper side front plate 324 and the flat-plate speaker 311 are disposed instead of the upper side front plate 24 of the electronic keyboard instrument 1 in the first embodiment, and the flat-plate speaker 312 is disposed instead of the upper side back plate 22 and the lower side back plate 23. In addition, in the electronic keyboard instrument 301, the pair of cone type speakers 3 of the electronic keyboard instrument 1 in the first embodiment is omitted, and the sound releasing holes 25*a* are covered by a speaker grill or a net.

In a state that the keyboard unit 5 is exposed (the keyboard cover 6 is opened), the flat-plate speaker 311 is disposed closer to the upper side (the arrow U side) than the upper end of the keyboard cover 6, and the upper side front plate 324 is disposed downward of the flat-plate speaker 311 (in the arrow D direction).

In addition, the flat-plate speaker 311 and the flat-plate speaker 312 are disposed across the space between the pair of side plates 21 in the left-right direction (the arrow L-R direction). Thereby, a part of the front surface of the main body portion 302 is formed by the flat-plate speaker 311, and the entire back surface of the main body portion 302 is formed by the flat-plate speaker 312. In this manner, the flat-plate speakers 311 and 312 are configured as a part of the wall surface of the main body portion 302, and thereby the area of the flat-plate speakers 311 and 312 can be formed large. Thus, low-pitched musical sounds can be easily output from the flat-plate speakers 311 and 312.

Here, the surfaces on the frontward side (the arrow F side) of the flat-plate speakers 311 and 312 are defined as front surfaces 311*a* and 312*a*, and the surfaces on the backward side (the arrow B side) of the flat-plate speakers 311 and 312 are defined as back surfaces 311*b* and 312*b*.

The musical sounds output from the front surface 311*a* of the flat-plate speaker 311 are released toward the frontward side of the electronic keyboard instrument 301 (see the arrow C1). That is, the musical sounds output from the front surface 311*a* of the flat-plate speaker 311 are directly released toward the player.

The musical sounds output from the back surface 311*b* of the flat-plate speaker 311 are output toward the inside of the main body portion 302 (see the arrow C2). Although the musical sounds output from the back surface 311*b* of the flat-plate speaker 311 have directionality, the musical sounds are repeatedly reflected inside the main body portion 302 and released toward the frontward side of the electronic keyboard instrument 301 through the opening portions 2*a* and 2*b*. That is, the musical sounds output from the back surface 311*b* of the flat-plate speaker 311 are indirectly (repeatedly reflected) released toward the player.

In addition, the musical sounds output from the front surface 312*a* of the flat-plate speaker 312 are output toward the inside of the main body portion 302 (see the arrow C3). The musical sounds output from the flat-plate speaker 312 toward the inside of the main body portion 302 are made to directly pass through the opening portion 2*b* or the sound releasing holes 25*a*, or repeatedly reflected inside the main body portion 302 to pass through the opening portions 2*a* and 2*b* or the sound releasing holes 25*a*, and are released toward the frontward side of the electronic keyboard instrument 301.

In this manner, the direct musical sounds from the flat-plate speakers 311 and 312 and the indirect musical sounds are respectively released toward the player, and the direct musical sounds or the indirect musical sounds are respectively released from the opening portions 2*a* and 2*b* at two places, and thereby the steric sound-field space simulating the acoustic piano can be formed.

On the other hand, the musical sounds output from the back surface 312*b* of the flat-plate speaker 312 are directly released toward the backward side of the electronic keyboard instrument 301 (see the arrow C4). Thereby, the musical sounds can be easily released toward the audience or the like on the backward side of the electronic keyboard instrument 301.

In addition, because the entire back surface of the main body portion 302 is formed by the flat-plate speaker 312, the table of the upright acoustic piano can be simulated by the flat-plate speaker 312. Thereby, the musical sounds simulating the upright acoustic piano can be easily released.

Next, the configuration of an electronic keyboard instrument 401 in a fourth embodiment is described with reference to FIG. 5. Besides, the same parts as in the above embodiments are denoted by the same reference signs, and description thereof is omitted. (a) and (b) of FIG. 5 are top views of the electronic keyboard instrument 401 in the fourth embodiment. Besides, (b) of FIG. 5 shows a state in which a speaker supporting member 426 and a flat-plate speaker 410 shown in (a) of FIG. 5 are detached.

As shown in FIG. 5, the electronic keyboard instrument 401 in the fourth embodiment is configured as a grand-piano-shaped electronic keyboard instrument (electronic piano) which includes a main body portion 402 extending from the key supporting portion 4 to the backward side (the arrow B side), and a plurality (34 in the embodiment) of flat-plate speakers 410 supported by the main body portion 402.

Besides, although not shown, a leg member supporting the main body portion 402, and a large roof (a cover portion) which opens and closes an opening portion 402*a* of the upper surface of the main body portion 402 (on the near side in the direction perpendicular to the paper plane in FIG. 5) are attached to the electronic keyboard instrument 401. The large roof is arranged to be rotatable around the axis along the front-back direction at the left end of the main body portion 402.

The main body portion 402 is a housing formed by combining plate-shaped bodies made of resin, metal, or wood and is formed into a box shape in which the upper surface of the main body portion 402 is opened. The main body portion 402 includes a side plate 421 constituting the side surface or back surface of the main body portion 402, a speaker supporting member 426 fixed to the side plate 421, and a bottom plate 428 (see (b) of FIG. 5) disposed downward of the speaker supporting member 426 (on the inner side in the direction perpendicular to the paper plane in (a) of FIG. 5).

The side plate 421 constituting the back end of the main body portion 402 is formed in a bending manner, and thereby the depth dimension from the keyboard unit 5 (key 51) to the back end of the main body portion 402 is made larger on the low-pitched sound side (the arrow L side) than the high-pitched sound side (the arrow R side).

The speaker supporting member 426 has an outer shape along the inner peripheral surface of the side plate 421, and the speaker supporting member 426 is fixed to the inner peripheral surface on the upper end side of the side plate 421 (the near side in the direction perpendicular to the paper plane in (a) of FIG. 5) in a posture substantially parallel to the opening surface of the opening portion 402*a*. Besides, the "opening surface" of the opening portion 402*a* refers to the surface along the upper end of the side plate 421.

A plurality of rectangular through holes (not shown) is formed on the speaker supporting member 426, and the plurality of through holes is disposed to line up in the front-back direction and the left-right direction to thereby form the speaker supporting member 426 in a grid shape.

The bottom plate 428 has an outer shape along the inner peripheral surface of the side plate 421, and the bottom plate 428 is fixed to the inner peripheral surface on the lower end side of the side plate 421 (the inner side in the direction perpendicular to the paper plane in (a) of FIG. 5). On the bottom plate 428, a plurality (eight in the embodiment) of sound releasing holes 428*a* for passing the musical sounds output from the flat-plate speaker 410 is formed. Besides, the sound releasing holes 428*a* are formed into a rectangular shape, a circular shape, an elliptical shape and the like, and the sound releasing holes 428*a* are respectively formed with different sizes, but in the embodiment, the sound releasing holes 428*a* are denoted by the same reference sign and described.

The flat-plate speaker 410 is formed in the same way as the flat-plate speaker 10 in the first embodiment except that the dimensions in the left-right direction and the front-back direction are respectively different.

Each flat-plate speaker 410 is fixed to the speaker supporting member 426 in a state of being fitted into the through holes (not shown) of the speaker supporting member 426. Thereby, each flat-plate speaker 410 is disposed to line up in a grid shape on the upper surface of the main body portion 402 in a posture substantially parallel to the opening surface of the opening portion 402*a*.

In this manner, by disposing a plurality (34 in the embodiment) of flat-plate speakers 410, the musical sounds having different tones can be respectively output from each flat-plate speaker 410 corresponding to the keys 51 that are pressed. Thereby, the steric sound-field space simulating the acoustic piano can be formed.

In addition, the musical sounds output from the upper surface of the flat-plate speaker 410 are reflected by the large roof (not shown) covering the opening portion 402*a* of the main body portion 402 and released around the electronic keyboard instrument 401, and the musical sounds output from the lower surface of the flat-plate speaker 410 are released to the outside of the main body portion 402 through the sound releasing holes 428*a* of the bottom plate 428. Thereby, the steric sound-field space can also be formed, and the musical sounds simulating the acoustic piano can be easily released.

In addition, because the plurality of flat-plate speakers 410 is disposed to line up in a grid shape on the speaker supporting member 426, the sounds up to a lower-pitch range can be output from each flat-plate speaker 410. Thus, the musical sounds from the low-pitch range to the high-pitch range can be easily released in a full-range from each flat-plate speaker 410, and thus the musical sounds simulating the acoustic piano can be easily released.

Next, the configuration of an electronic keyboard instrument 501 in a fifth embodiment is described with reference to FIG. 6. Besides, the same parts as in the above embodiments are denoted by the same reference signs, and description thereof is omitted. FIG. 6 is a front perspective view of the electronic keyboard instrument 501 in the fifth embodiment.

As shown in FIG. 6, the electronic keyboard instrument 501 in the fifth embodiment is configured as a stage piano which includes a main body portion 502, and the keyboard unit 5 and a flat-plate speaker 510 supported by the main body portion 502.

The main body portion 502 is a housing formed by combining plate-shaped bodies made of resin, metal, or wood. The main body portion 502 includes a front panel 521, a back panel 522 disposed facing the front panel 521 in the front-back direction (the arrow F-B direction), and a pair of end panels 523 that connects the ends of the front panel 521 and the back panel 522 in the left-right direction (the arrow L-R direction). The keys 51 and the flat-plate speaker 510 are surrounded by the front panel 521, the back panel 522, and the pair of end panels 523.

The flat-plate speaker 510 is formed in the same way as the flat-plate speaker 10 in the first embodiment except that the dimensions in the left-right direction and the front-back direction are respectively different. The dimension in the left-right direction of the flat-plate speaker 510 is set substantially equal to the distance at which the pair of end panels 523 faces each other.

Because the flat-plate speaker 510 is disposed on the upper surface of the main body portion 502 closer to the backward side than the keyboard unit 5, the musical sounds output from the flat-plate speaker 510 can be directly released to the player. In addition, because the area of the flat-plate speaker 510 can be formed large by disposing the flat-plate speaker 510 across the substantially entire length of the main body portion 502 in the left-right direction, the low-pitched musical sounds can be easily output from the flat-plate speaker 510.

As described above, according to the electronic keyboard instruments 1, 201, 301, 401, 501 of the above embodiments, the musical sounds are output using a fully-driven flat-plate speaker, which vibrates the vibrating membrane 12 by an electromagnetic force, and thus it is not necessary to apply a bias voltage as in a case of using an electrostatic speaker. Accordingly, power supply for applying the voltage is not required, and thus the increase in product cost can be suppressed.

As described above, the description is made based on the above embodiments, but the invention is not limited to the above embodiments, and it can be easily speculated that various modifications and improvements can be made within the scope of the gist of the invention.

In the above embodiments, regarding the flat-plate speakers 10, 311, 312, 410 and 510, the front surfaces of the flat-plate speakers 10, 311, 312, 410 and 510 may be covered by a speaker grill or a net.

From the first embodiment to the third embodiment, the back ends of the pair of side plates 21 may be disposed to be rotatable around the axis in the up-down direction, and the opening portion (the first opening portion) formed on the lateral side of the main body portion 2 may be openable and closable by the pair of side plates 21. In this case, preferably, the flat-plate speakers are inclined with respect to the opening portion (the front end side of the flat-plate speaker is disposed closer to the inner side of the main body portion 2 than the back end side). Thereby, the musical sounds can be easily released toward the frontward side of the electronic keyboard instruments 1, 201, 301 by reflecting the musical sounds output from the flat-plate speakers by the pair of side plates 21.

In the first embodiment and the second embodiment, the front end of the top plate 27 may be made to protrude closer to the frontward side than the upper side front plate 24 while the top plate 27 blocks the opening portion 2*a*. Thereby, all of the musical sounds output from the front surface 10*a* of the flat-plate speaker 10 can be easily reflected by the top plate 27, and thus the musical sounds can be effectively released toward the frontward sides (the player) of the electronic keyboard instruments 1 and 201.

In the first embodiment and the second embodiment, the sound releasing holes may be formed on the upper side back plate 22. Thereby, the musical sounds output from the flat-plate speakers 10 toward the upper side back plate 22 can be easily released toward the backward side of the electronic keyboard instruments 1 and 201 through the sound releasing holes of the upper side back plate 22.

In the first embodiment and the second embodiment, the case is described in which the inclination of the flat-plate speaker 10 with respect to the opening surface of the opening portion 2*a* is set to 28° and the inclination of the top plate 27 with respect to the opening surface of the opening portion 2*a* is set to 20°, but the inclination is not limited hereto. For example, the inclination angle of the flat-plate speaker 10 with respect to the opening surface of the opening portion 2*a* may be set to 20° or more and less than 40°, and the inclination angle of the top plate 27 may be set to 10° or more and less than 30°.

In the first embodiment and the second embodiment, the reflection board different from the chassis 41 may be disposed from the opening portion 2*b* to the upper side back plate 22. In this case, the reflection board is preferably disposed to be lowered and inclined toward the front end side. Thereby, the musical sounds output from the back surface 10*b* of the flat-plate speaker 10 can be easily released toward the frontward sides of the electronic keyboard instruments 1 and 201.

In the first embodiment, in addition to the cone type speaker 3 and the flat-plate speaker 10, a cone type speaker having a size the same as or different from that of the cone type speaker 3 may be arranged. Thereby, the steric sound-field space simulating the acoustic piano can be easily formed.

In the third embodiment, the reflection board may be arranged in a region where the flat-plate speaker 311 and the flat-plate speaker 312 face each other in the front-back direction. In this case, the reflection board is preferably disposed to be raised and inclined or be lowered and inclined toward the frontward side. Thereby, the musical sounds output from the back surface 311*b* of the flat-plate speaker 311 or the front surface 312*a* of the flat-plate speaker 312 can be reflected by the reflection board and transmitted upward and downward. Thereby, the musical sounds can be reflected by the top plate 27 or the chassis 41 and easily released toward the frontward side of the electronic keyboard instrument 301.

In the third embodiment, the upper end of the flat-plate speaker 312 may be located on the side lower than the lower end of the flat-plate speaker 311 (the arrow D side). Thereby, the musical sounds output from the back surface 311*b* of the flat-plate speaker 311 and the musical sounds output from the front surface 312*a* of the flat-plate speaker 312 can be prevented from interference with each other.

In the third embodiment, in addition to the flat-plate speaker 311 (or omitting the flat-plate speaker 311), a flat-plate speaker may be arranged instead of the lower side front plate 25 of the main body portion 2.

In the fourth embodiment, the case in which the plurality (34 in the embodiment) of flat-plate speakers 410 is fitted into the plurality of through holes (not shown) of the speaker supporting member 426 is described, but the embodiment is not limited hereto, and the flat-plate speakers 410 may not be arranged for a part of the through holes. Thereby, the musical sounds output from the lower surfaces of the flat-plate speakers 410 and reflected by the bottom plate 428 can be released to the upward side of the main body portion 402 via the through holes of the speaker supporting member 426.

In the third embodiment, the case in which the pair of cone type speakers 3 is omitted is described, but the embodiment is not limited hereto. For example, a cone type speaker having a size the same as or different from that of the cone type speaker 3 may be used in combination with the flat-plate speakers 311 and 312. Thereby, the steric sound-field space simulating the acoustic piano can be easily formed.

In the fourth embodiment, the musical sounds having the same tone may be output from the plurality of flat-plate speakers 410 disposed at adjacent or separated positions corresponding to the keys 51 that are pressed.

In the fourth embodiment, the musical sounds may be output from only a part of the flat-plate speakers 410 among the plurality of flat-plate speakers 410 corresponding to the keys 51 that are pressed.

In the fourth embodiment, the plurality of flat-plate speakers having a band shape elongated in the front-back direction may be disposed to line up on the left and right sides of the speaker supporting member 426 (the flat-plate speakers may be disposed to line up in the left-right direction only instead of being disposed to line up in a grid shape). In this case, the closer the plurality of flat-plate speakers is located to the low-pitched sound side, the larger the area of the plurality of flat-plate speakers is, and thus it is preferable that the low-pitched musical sounds are output from the flat-plate speakers located on the low-pitched sound side, and the high-pitched musical sounds are output from the flat-plate speakers located on the high-pitched sound side. Thereby, good musical sounds can be easily output from all of the flat-plate speakers in a full-range.

In the fourth embodiment, the case is described in which each flat-plate speaker 410 is disposed in the posture substantially parallel to the opening surface of the opening portion 402*a*, but the embodiment is not limited hereto, and each flat-plate speaker 410 may be disposed inclined with respect to the opening surface of the opening portion 402*a*. For example, the flat-plate speakers 410 are raised and inclined toward the left end side of the main body portion 402 (the rotational axis side of the large roof), and thereby the musical sounds output from the flat-plate speaker 410 can be reflected by the large roof and easily released toward the outside of the main body portion 402. In addition, each flat-plate speaker 410 is disposed to be raised and inclined toward the backward side, and thereby the musical sounds can be easily released toward the frontward side (the player side) of the electronic keyboard instrument 401.

In the fifth embodiment, the flat-plate speakers 510 may be divided so that a plurality of flat-plate speakers 510 is disposed to line up in the left-right direction. Thereby, the musical sounds having different tones can be respectively output from each flat-plate speaker 510 corresponding to the keys 51 that are pressed, and thus the steric sound-field space can be formed. In addition, for example, the low-pitched musical sounds may be output from the flat-plate speakers 510 disposed on the low-pitched sound side, and the high-pitched musical sounds may be output from the flat-plate speakers 510 disposed on the high-pitched sound side.

What is claimed is:

1. An electronic keyboard instrument, comprising:

a plurality of keys, a housing that supports the plurality of keys, and one or more speakers arranged in the housing;

wherein at least one of the speakers is configured as a flat-plate speaker that comprises a vibrating membrane on which a pattern of a conducting wire is formed and a pair of magnet plates disposed facing both surfaces of the vibrating membrane, and the flat-plate speaker vibrates the vibrating membrane with an electromagnetic force accompanying energization of the conducting wire.

2. The electronic keyboard instrument according to claim 1, wherein the housing comprises:

a first opening portion that is formed on a side surface or an upper surface of the housing and disposed facing the flat-plate speaker, and a cover portion that rotates around an axis along an edge of the first opening portion and opens and closes the first opening portion;

wherein the flat-plate speaker is disposed inclined with respect to an opening surface of the first opening portion.

3. The electronic keyboard instrument according to claim 2, wherein the flat-plate speaker is disposed near the first opening portion, and a front end side of the flat-plate speaker is disposed closer to an inner side of the housing than a back end side of the flat-plate speaker.

4. The electronic keyboard instrument according to claim 2, wherein the housing is formed into an upright piano shape comprising:

a main body portion which is formed into a substantially rectangular parallelepiped shape elongated in an up-down direction and in which the first opening portion is formed on the upper surface of the housing, and a key supporting portion which protrudes to a front surface of the main body portion and supports the plurality of keys;

wherein the main body portion comprises:

a second opening portion which is formed on the front surface of the main body portion and passes through a key supporting portion, and wherein the key support portion comprises a reflection board which is arranged lower than the flat-plate speaker and causes musical sounds output from the flat-plate speaker to be reflected toward a second opening portion.

5. The electronic keyboard instrument according to claim 4, wherein the reflection board is configured as a chassis which supports the plurality of keys.

6. The electronic keyboard instrument according to claim 4, wherein the reflection board protrudes from the second opening portion toward a back surface side of the housing, and a space in the housing is divided by the reflection board as an upper space above the reflection board and a lower space below the reflection board.

7. The electronic keyboard instrument according to claim 1, wherein the housing comprises sound releasing holes formed on a front surface of the housing and disposed facing the flat-plate speaker.

8. The electronic keyboard instrument according to claim 1, wherein the housing is formed into an upright piano shape comprising:

a main body portion which is formed into a substantially rectangular parallelepiped shape elongated in an up-down direction, and a key supporting portion which protrudes to a front surface of the main body portion and supports the plurality of keys;

wherein the flat-plate speaker is disposed on each of the front surface and a back surface of the main body portion.

9. The electronic keyboard instrument according to claim 1, wherein the housing is formed into a grand piano shape comprising:

a plurality of leg portions, and a main body portion which is supported by the plurality of leg portions and of which a depth dimension from the keys is made larger on a low-pitched sound side than on a high-pitched sound side; and a plurality of the flat-plate speakers is disposed on an upper surface of the main body portion.

10. The electronic keyboard instrument according to claim 9, wherein the plurality of flat-plate speakers is disposed to line up in a grid shape.

11. The electronic keyboard instrument according to claim 9, wherein the main body portion comprises an upper plate by which the flat-plate speaker is supported, and a bottom plate located downward of the upper plate; and wherein the bottom plate comprises sound releasing holes formed facing the flat-plate speaker.

12. An electronic keyboard instrument equipped with at least one flat-plate speaker, wherein the flat-plate speaker comprises a vibrating membrane on which a pattern of a conducting wire is formed; and a pair of magnet plates disposed facing both surfaces of the vibrating membrane, and wherein the flat-plate speaker vibrates the vibrating membrane with an electromagnetic force accompanying energization of the conducting wire, and the electronic keyboard instrument comprises:

a plurality of keys; and a housing that supports the plurality of keys; and wherein the housing comprises:

a main body portion;

a first opening portion that is formed on a side surface or an upper surface of the main body portion;

a key supporting portion which protrudes to a front surface of the main body portion and supports the plurality of keys; and a second opening portion which passes through a key supporting portion, and wherein the flat-plate speaker is disposed inclined with respect to an opening surface of the first opening portion, or the flat-plate speaker is disposed in a position causing musical sounds output from the flat-plate speaker to be reflected toward a second opening portion, or the flat-plate speaker is disposed on each of the front surface and a back surface of the main body portion, or the flat-plate speaker is disposed on the upper surface of the main body portion.

13. The electronic keyboard instrument according to claim 12, wherein the support portion comprises a reflection board which is arranged inside the housing, such that musical sounds output from the flat-plate speaker to be reflected toward a second opening portion.

14. The electronic keyboard instrument according to claim 13, wherein the reflection board is configured as a chassis which supports the plurality of keys.

15. The electronic keyboard instrument according to claim 14, wherein the reflection board protrudes from the second opening portion toward a back surface side of the housing, and a space in the housing is divided by the reflection board as an upper space above the reflection board and a lower space below the reflection board.

16. The electronic keyboard instrument according to claim 12, wherein the housing comprises sound releasing holes formed on a front surface of the housing and disposed facing the flat-plate speaker.

17. The electronic keyboard instrument according to claim 12, wherein the main body portion comprises an upper plate by which the flat-plate speaker is supported, and a bottom plate located downward of the upper plate; and wherein the bottom plate comprises sound releasing holes formed facing the flat-plate speaker.

18. A method for releasing sound of an electronic keyboard instrument, comprising:

providing a housing for supporting a plurality of keys;

arranging at least one flat-plate speaker in the housing, wherein the flat-plate speaker comprises a vibrating membrane on which a pattern of a conducting wire is formed and a pair of magnet plates disposed facing both surfaces of the vibrating membrane; and vibrating the vibrating membrane with an electromagnetic force accompanying energization of the conducting wire.

19. The method according to claim 18, comprising:

forming a first opening portion on a side surface or an upper surface of a main body portion of the housing;

providing a key supporting portion to protrude to a front surface of the main body portion and support the plurality of keys;

forming a second opening portion passing through a key supporting portion of the main body portion;

disposing the flat-plate speaker inclined with respect to an opening surface of the first opening portion inside the housing, or disposing the flat-plate speaker in a position causing musical sounds output from the flat-plate speaker to be reflected toward the second opening portion of the main body, or disposing the flat-plate speaker on each of the front surface and a back surface of the main body portion, or disposing the flat-plate speaker on the upper surface of the main body portion.

* * * * *